US009002041B2

(12) United States Patent
McGarry et al.

(10) Patent No.: US 9,002,041 B2
(45) Date of Patent: Apr. 7, 2015

(54) METHOD AND APPARATUS FOR IMPROVED ACOUSTIC TRANSPARENCY

(71) Applicant: Logitech Europe S.A., Morges (CH)

(72) Inventors: Steve McGarry, Vancouver, WA (US); Joy E. Lyons, Vancouver, WA (US); Jeff Anderson, Camas, WA (US); Timothy Valentine, Vancouver, WA (US)

(73) Assignee: Logitech Europe S.A., Lausanne (CH)

( * ) Notice: Subject to any disclaimer, the term of this patent is extended or adjusted under 35 U.S.C. 154(b) by 0 days.

(21) Appl. No.: 13/894,060

(22) Filed: May 14, 2013

(65) Prior Publication Data

US 2014/0341417 A1 Nov. 20, 2014

(51) Int. Cl.
*H04R 1/02* (2006.01)
*H04R 31/00* (2006.01)
*D06M 15/256* (2006.01)

(52) U.S. Cl.
CPC ..... *H04R 1/02* (2013.01); *H04R 31/00* (2013.01); *D06M 15/256* (2013.01); *H04R 1/023* (2013.01)

(58) Field of Classification Search
CPC .... H04R 1/02; H04R 1/023; H04R 2307/021; H04R 2307/025; H04R 2307/027; H04R 2307/029; H04R 2201/02; H04R 2201/029
USPC ..... 381/345–348, 354, 359, 372, 386, 391, 381/189, 426–428; 181/148, 149, 151, 181/167–170; 428/411.1
See application file for complete search history.

(56) References Cited

U.S. PATENT DOCUMENTS

| | | | | |
|---|---|---|---|---|
| 5,328,576 | A * | 7/1994 | Paskalov et al. | 204/164 |
| 5,641,844 | A * | 6/1997 | Thompson et al. | 526/245 |
| 5,828,012 | A * | 10/1998 | Repolle et al. | 181/175 |
| 6,287,640 | B1 * | 9/2001 | McClain et al. | 427/388.1 |
| 2002/0193136 | A1 * | 12/2002 | Halkosaari et al. | 455/550 |
| 2005/0077102 | A1 * | 4/2005 | Banter et al. | 181/149 |
| 2005/0089187 | A1 * | 4/2005 | Turnmire et al. | 381/396 |
| 2007/0003084 | A1 * | 1/2007 | Huynh et al. | 381/323 |
| 2010/0322452 | A1 * | 12/2010 | Ladabaum et al. | 381/375 |
| 2012/0051018 | A1 * | 3/2012 | Ollgaard | 361/781 |
| 2012/0121112 | A1 * | 5/2012 | Lin et al. | 381/191 |
| 2012/0308762 | A1 | 12/2012 | Legein et al. | |

(Continued)

FOREIGN PATENT DOCUMENTS

| | | | |
|---|---|---|---|
| EP | 2084320 A2 | 8/2009 | |
| EP | 2422888 A2 * | 2/2012 | B05D 5/08 |

(Continued)

OTHER PUBLICATIONS

Hauser, Peter J. And Ahmed El-Shafei, "Polymerization of Fluorocarbon Monomers onto Cotton with Atmospheric Pressure Plasma", AATCC Symposium Papers, (Jun. 2008), p. 160.

(Continued)

*Primary Examiner* — Curtis Kuntz
*Assistant Examiner* — Joshua A Kaufman
(74) *Attorney, Agent, or Firm* — Kilpatrick Townsend & Stockton LLP

(57) ABSTRACT

A process for the manufacture of a speaker cover comprises loading the speaker cover into a plasma chamber, introducing a fluoro monomer into the plasma chamber, pulsing plasma for processing, removing any excess monomer gas from the plasma chamber, and removing the speaker cover from the plasma chamber.

20 Claims, 5 Drawing Sheets

(56) References Cited

U.S. PATENT DOCUMENTS

| | | | | |
|---|---|---|---|---|
| 2013/0117978 | A1* | 5/2013 | Carr et al. | 28/169 |
| 2014/0072161 | A1* | 3/2014 | Boyle et al. | 381/346 |
| 2014/0083296 | A1* | 3/2014 | Sanders | 96/11 |
| 2014/0155522 | A1* | 6/2014 | Simpson et al. | 523/400 |

FOREIGN PATENT DOCUMENTS

| | | | | |
|---|---|---|---|---|
| WO | 95/09515 | 4/1995 | | |
| WO | WO 9509515 A1 * | 4/1995 | | H04R 1/02 |

OTHER PUBLICATIONS

Castelvetro, V. et al., "Graft Polymerisation of Functional Acrylic Monomers onto Cotton Fibres Activated by Continuous Ar Plasma", *Plasma Processes and Polymers*, (Jan. 16, 2006), vol. 3, Issue 1, pp. 48-57.

* cited by examiner

METHOD AND APPARATUS FOR IMPROVED ACOUSTIC TRANSPARENCY

BACKGROUND OF THE INVENTION

Typical speaker material used to cover a speaker may consist of a polyester knit material. These materials work well because they are light and thin and more acoustically transparent than many heavier fabrics or other materials. However, these materials are susceptible to being torn or stretched. A more durable speaker fabric may be desired to cover a speaker, particularly for speakers that are portable and handled frequently by a user. However, more durable fabrics typically consist of thicker and/or denser material and thus, are not acoustically transparent or cause degraded acoustic transparency when placed in front of speaker drivers. For example, material such as thick fabrics, metal, wood or plastic may offer more protection to the speaker but since these materials are not acoustically transparent, sound quality is lost. A polymer such as a polyurethane spray could be applied to the speaker fabric to make the fabric water resistant. However, putting a coat of polyurethane paint or varnish over speaker fabric may also reduce acoustic transparency. What is needed is a durable speaker fabric that is also acoustically transparent.

Embodiments of the invention solve these and other problems individually and collectively.

BRIEF SUMMARY OF THE INVENTION

Embodiments of the invention are directed to a method and apparatus for a speaker cover and speaker product treated by a plasma process.

One embodiment of the invention is directed to a process for the manufacture of a speaker cover comprising loading the speaker cover into a plasma chamber, introducing a fluoro monomer into the plasma chamber, pulsing plasma for processing, removing any excess monomer gas from the plasma chamber, and removing the speaker cover from the plasma chamber.

Another embodiment of the invention is directed to a speaker cover comprising a material treated by a plasma process comprising receiving the material into the plasma chamber, achieving a predetermined minimum vacuum, introducing gas into the plasma chamber for a pre-cleaning treatment phase, pulsing plasma for pre-cleaning, introducing a fluoro monomer into the plasma chamber, pulsing plasma for processing, removing any excess monomer gas from the plasma chamber, and releasing the vacuum.

Another embodiment of the invention is directed to a speaker cover comprising a porous material having an initial first acoustic transparency, a plasma coating on the porous material causing a second acoustic transparency, and an attachment member for attaching the porous material to a speaker housing.

Another embodiment of the invention is directed to a speaker product comprising a housing, at least once driver positioned substantially within the housing, and a speaker cover coupled with the housing, the speaker cover comprising a material and a coating of fluoro monomer on the material.

These and other embodiments of the invention are described in further detail below.

DETAILED DESCRIPTION OF THE INVENTION

Embodiments of the invention provide for a durable speaker cover without degrading the acoustic performance of a speaker product by using a plasma process to coat a speaker cover or entire speaker product. When the inventors were looking for a more durable fabric to use for a speaker cover, they tried numerous different types of fabrics. They then decided to try a plasma treatment. The inventors expected the acoustic transparency to decrease with the plasma treatment because it is generally known that anything that is added to fabric typically decreases the acoustic transparency. The fact that testing showed that speaker cover fabric with the plasma treatment did not decrease the acoustic performance of the speaker, is an unexpected result of the present invention and stands in sharp contrast to the results predicted by the inventors. It is counterintuitive that adding something to the material of a speaker cover would not decrease the acoustic transparency of the speaker cover.

Applying a plasma treatment to a speaker cover or speaker product provides for many additional advantages. For example, treating the speaker cover or entire speaker product with plasma allows for a water and dirt resistant product. This may be particularly advantageous for portable speaker products that may be handled frequently by a user and taken outside, traveled with, or generally moved around frequently. The plasma treatment allows the speaker cover/fabric to stay cleaner so that the acoustic performance does not decrease because of clogged pores due to something spilled on the speaker product.

Figure 1:
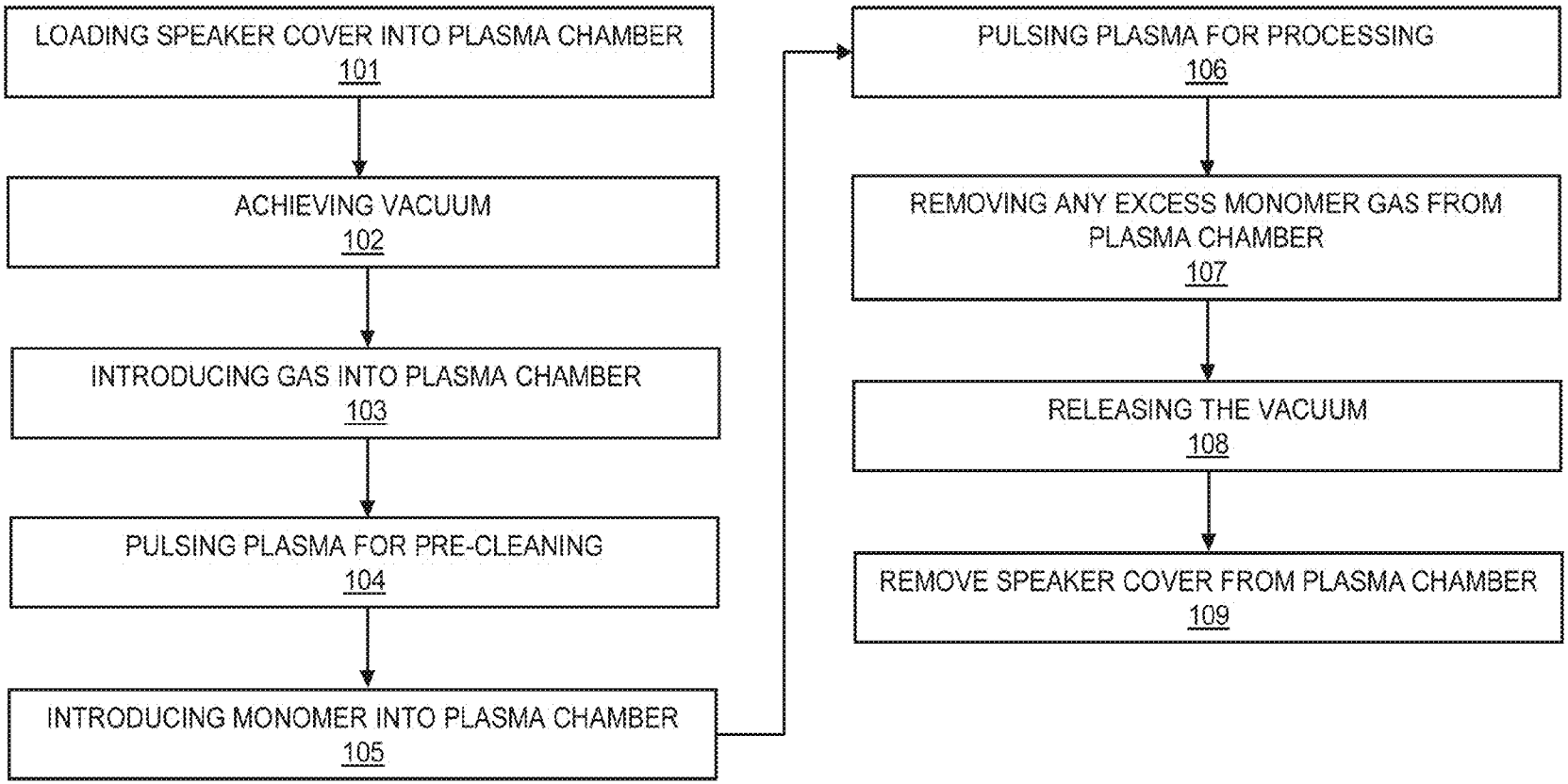
FIG. 1 shows a flowchart illustrating steps in a method according to an embodiment of the invention.

FIG. 1 shows a flow chart including a general method according to an embodiment of the invention.

First, one or more speaker products may be placed into a plasma chamber. The plasma chamber may be manufactured by a company such a Europlasma. The plasma process may be similar to the process described in U.S. Pub. No. 2012/0308762 directed to using a plasma process for a printed circuit board to protect the printed circuit board from physical contamination. A speaker product has very different characteristics than a printer circuit board and thus, different considerations were made to apply such a process to a speaker product. Appropriate parameters for a speaker product were determined by hard work and experimentation by the inventors.

Figure 5:
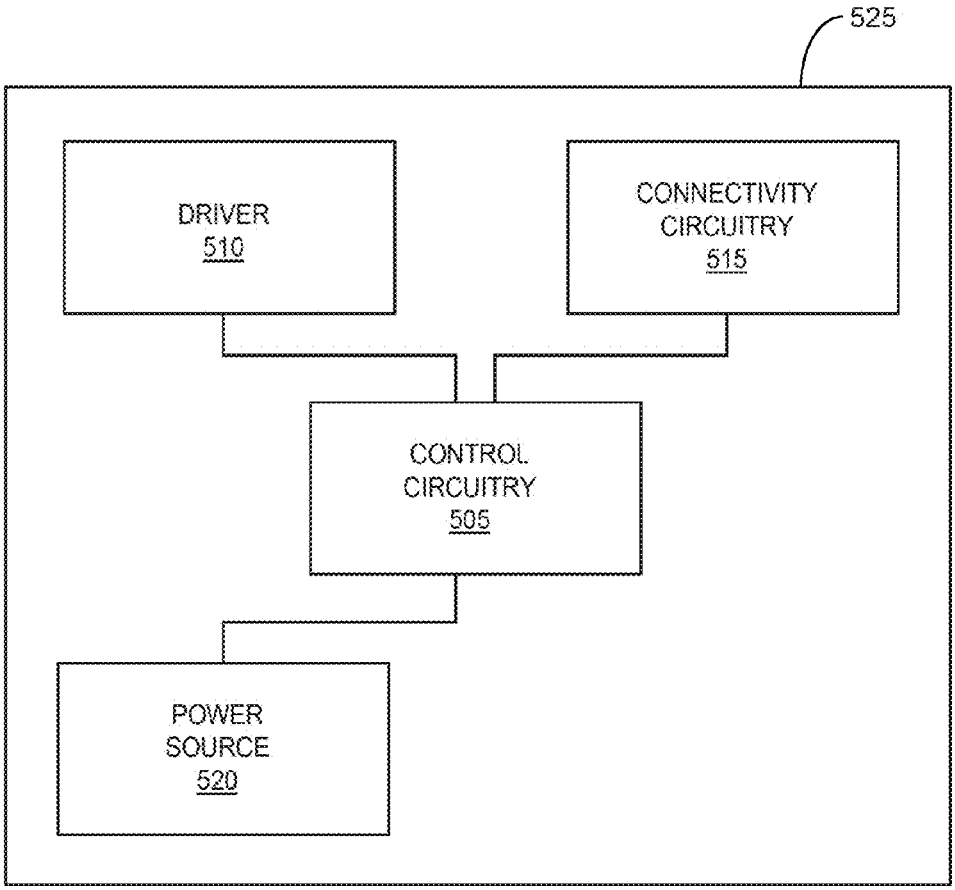
FIG. 5 shows exemplary components of a speaker according to embodiments of the invention.

The speakers described throughout this application may comprise a housing 525 and speaker components positioned substantially within the housing as shown in FIG. 5. Exemplary speaker components may include at least one driver 510, control circuitry 505, connectivity circuitry 515, and a power source 520. The power source 520 may include a battery, and/or circuitry to connect to an external power source (e.g., an electric outlet). The driver 510 can refer to a device that converts electrical signals from an electrical source into sound for a listener.

Figure 2:
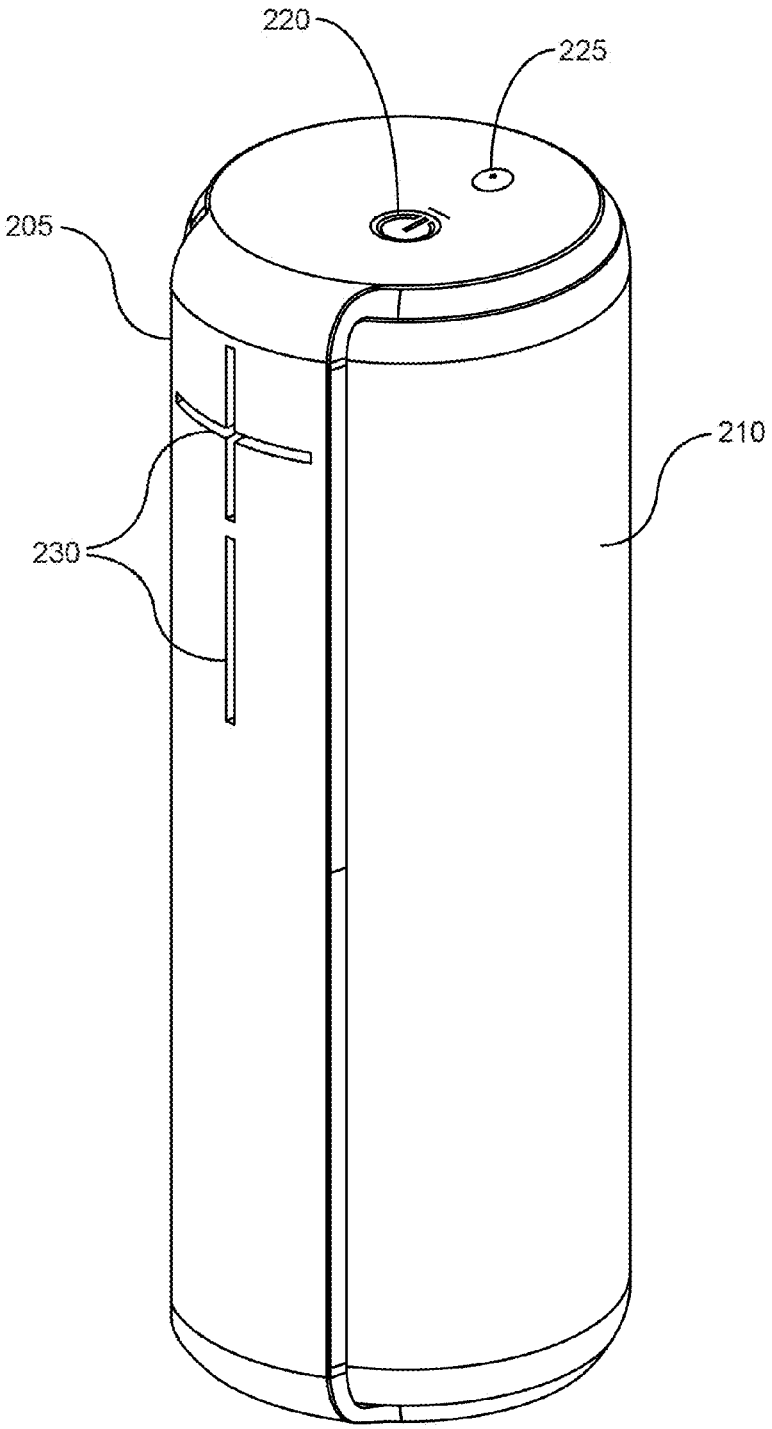
FIG. 2 shows an exemplary speaker product according to an embodiment of the invention.

As shown in FIG. 2, the housing 205 may comprise a speaker cover 210 that may cover one or more of the speaker components. The speaker cover may comprise a material such as metal, plastic, fabric, etc. An exemplary speaker cover fabric may include woven or knit fabrics consisting of nylons, polyesters, elastomers, combinations of these or other man made polymers (e.g., woven blends of 2%-13% thermoplastic polyurethane, 11%-21% polyester and 72%-82% polyamide, pure polyamide woven materials, pure polyester woven materials and pure thermoplastic elastomer woven material). The speaker cover may comprise a porous material. The speaker cover may have an initial first acoustic transparency before treatment by a plasma process and a second acoustic transparency after treatment by a plasma process. The entire housing may comprise the speaker cover, or the speaker cover may comprise a portion of the housing. The speaker cover may comprise at least one attachment member for attaching the speaker cover to the housing. An attachment member may include a clip, glue, or other attachment means.

The housing 205 may include input ports (e.g., 225) to connect to various audio input sources (e.g., mobile phones, tablet devices, MP3 players, etc.) through a physical connection (e.g., using a cable to plug into the audio input source) or via wireless means, or to connect power, etc. The housing may include an LCD screen or various buttons to control features of the speaker such as a power button 220, volume controls 230, etc.

The entire speaker product may be placed or loaded into the plasma chamber or just the speaker cover may be placed in the chamber. Placing just the speaker cover in the chamber may allow for a larger quantity of speaker covers to be coated at once, reducing the cost of coating the speaker cover. This may be advantageous if the end speaker product is a large product where not many would fit in the plasma chamber at one time. This may also be advantageous if the speaker product contains components that should not be exposed to the plasma process. Placing the entire product in the plasma chamber may allow for the entire product to be treated including, for example, connectors, drivers, any buttons exposed, etc.

To place the one or more speaker cover or entire speaker product into the plasma chamber, the one or more speaker cover or entire speaker product may be placed onto one or more racks and then the racks may be placed or loaded into the open plasma chamber. The plasma chamber door is then closed.

After placing or loading the one or more speaker cover or entire speaker product into the plasma chamber (step 101), ambient air from the plasma chamber may be removed by achieving a vacuum (step 102) of between 10 millitor (mT) and 1000 mT. Through hard work and experimentation, the inventors found that when placing an entire speaker product in the plasma chamber, a lower maximum vacuum may need to be used because a higher pressure may result in damaging the driver (e.g., sucking the diaphragm out of the driver) and thus, the speaker product may be damaged. For example, in testing the speaker product in FIG. 2, the inventors found that a minimum of 20 mT worked best to be sure most of the oxygen and water, etc. was removed from the plasma chamber and a maximum of 100 mT worked well to be sure the product was not damaged. If just one or more speaker covers are in the plasma chamber, the inventors found that a higher pressure may be obtained without damaging the covers because speaker covers typically do not have more fragile components (e.g., such as a diaphragm).

Once a predetermined minimum vacuum is achieved (e.g., 10 mT, 20 mT, 50 mT, etc.), then gas may be introduced into the plasma chamber to pre-clean the one or more speaker covers or speaker products (step 103). Before introducing the gas, there may be a predetermined stabilization period (e.g., 60 seconds) for which the minimum vacuum must be sustained before introducing the gas to be sure that all the ambient air has been sucked out of the plasma chamber. There may be a maximum a time (e.g., 2400 seconds) for which to achieve the minimum vacuum, after which the vacuum may turn off or an alert may be provided (e.g., red light on the plasma chamber) to indicate that the minimum vacuum was not achieved.

Examples of gas used to pre-clean the one or more speakers covers or speaker products may include oxygen, nitrogen or helium. In a preferred embodiment nitrogen or helium may be used over oxygen because the inventors found that oxygen may be too aggressive to use on a speaker cover or speaker product and may cause discoloration of the speaker fabric or other material used for the speaker cover. Nitrogen may be preferred over helium because it may be less expensive than helium.

The gas may be introduced for a predetermined amount of time (e.g., 60 seconds). Next plasma is pulsed (e.g., at 250 watts, 350 watts, etc.) for a predetermined time for pre-cleaning (step 104).

Next, a predetermined amount of fluoro monomer (e.g., 120 sccm) may be introduced into the plasma chamber (step 105) for a predetermined amount of processing time (e.g., pulsed at 250 watts for 900 seconds) (step 106). The fluoro monomer may be introduced via a hot plate and the hot plate may have a predetermined temperature for heating the fluoro monomer (e.g., between 60-100° C.). An exemplary fluoro monomer may include: 1H,1H,2H,2H-TRIDECAFLUOROOCTYL METHACRYLATE.

After processing is complete any excess monomer gas may be removed from the chamber (step 107) and the vacuum may be released (step 108). The finished speaker products or speaker covers may then be removed from the plasma chamber (step 109).

Figure 3:
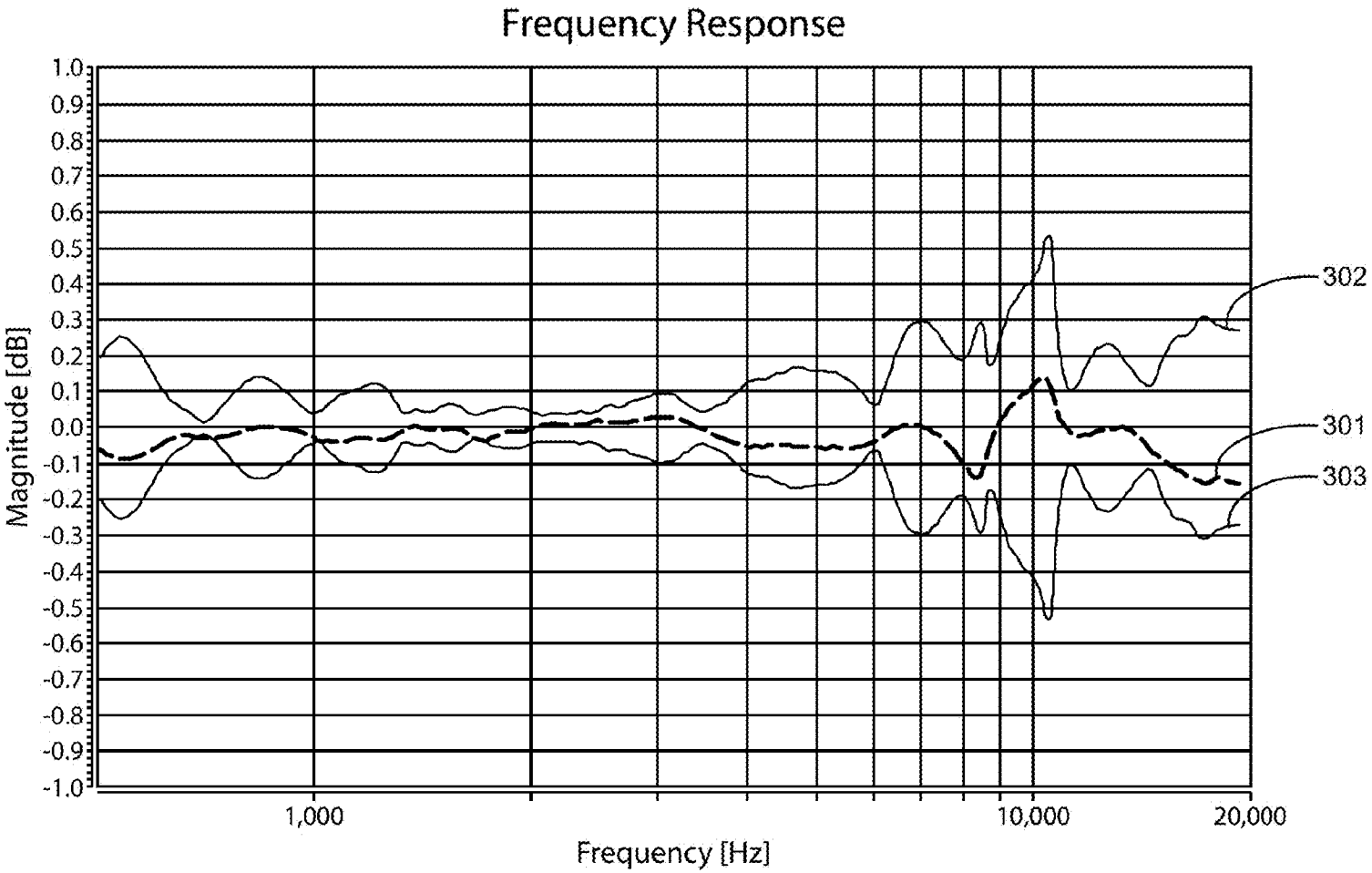
FIGS. 3-4 show acoustic performance of a speaker cover treated using a plasma process according to an embodiment of the invention.
Figure 4:
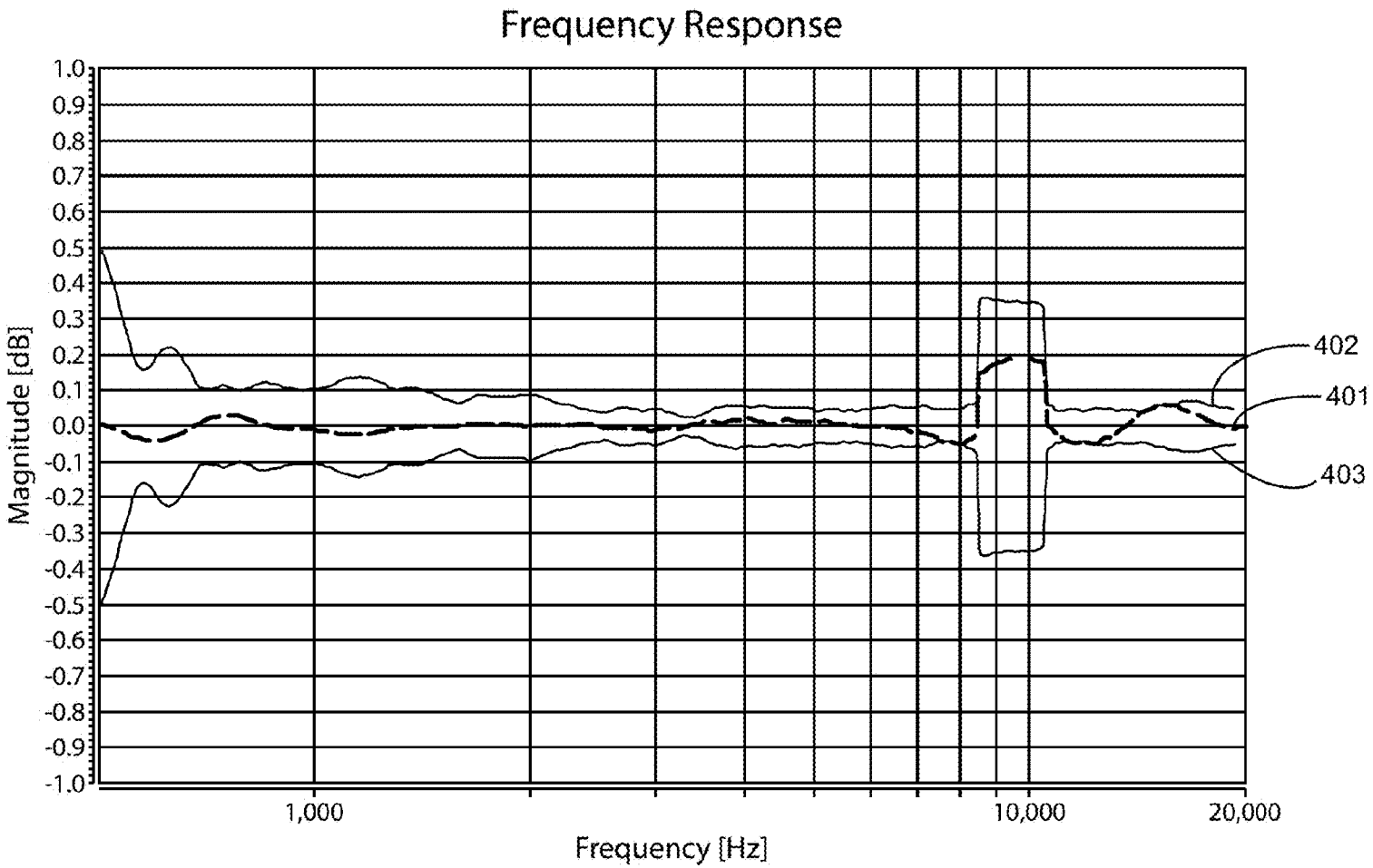

FIGS. 3 and 4 show acoustic performance of a speaker cover treated using a plasma process according to embodiments of the invention. As explained earlier, the inventors expected the acoustic transparency to decrease with the plasma treatment because it is generally known that anything that is added to fabric typically decreases the acoustic transparency. The fact that testing showed that speaker cover fabric with the plasma treatment did not decrease the acoustic performance of the speaker, is an unexpected result of the present invention and stands in sharp contrast to the results predicted by the inventors. It is counterintuitive that adding something to the material of a speaker cover would not decrease the acoustic transparency of the speaker cover.

FIG. 3 shows the transmission loss or acoustic transparency test results of a fabric that is a blend of thermoplastic elastomer, polyamide and polyester weave treated using a plasma process according to embodiments of the invention. The graph in FIG. 3 shows the average high frequency transmission loss difference between plasma-treated and non-plasma-treated fabric, as shown by the middle line 301. The frequency range tested is between 500 Hz and 20 kHz.

The top line 302 and the bottom line 303 show +/− two standard deviations of results of testing non-plasma-treated fabric. The top line 302 is plus two standard deviations and the bottom line 303 is minus two standard deviations. The middle line 301 indicates the average high frequency transmission loss difference between the plasma-treated fabric and the non-plasma-treated fabric. The fact that the middle line falls in between the top line 302 and the bottom line 303 indicates that there is no statistically significant measurable difference between the plasma-treated fabric and the non-plasma-treated fabric. Moreover, the fact that the middle line 301, is between the two lines 302 and 303, shows that the results are within a 95% confidence interval. Any differences in the measurement of transmission loss cannot be distinguished from sample to sample variation and test set up variability. Accordingly, as can be seen by line 301 of the graph, there is no statistically significant measurable difference in acoustic transparency between the plasma treated speaker cover fabric, and the non-plasma-treated speaker cover fabric.

FIG. 4 shows the transmission loss or acoustic transparency test results of a fabric that is polyester knit material treated using a plasma process according to embodiments of the invention. The graph in FIG. 4 shows the average high frequency transmission loss difference between plasma-treated and non-plasma-treated fabric, as shown by the middle line 401. The frequency range tested is between 500 Hz and 20 kHz.

The top line 402 and the bottom line 403 show +/− two standard deviations of results of testing non-plasma-treated fabric. The top line 402 is plus two standard deviations and the bottom line 403 is minus two standard deviations. The middle line 401 indicates the average high frequency transmission loss difference between the plasma-treated fabric and the non-plasma-treated fabric. The fact that the middle line falls in between the top line 402 and the bottom line 403 indicates that there is no statistically significant measurable difference between the plasma-treated fabric and the non-plasma treated fabric. Moreover, the fact that the middle line 401, is between the two lines 402 and 403, shows that the results are within a 95% confidence interval. Any differences in the measurement of transmission loss is not distinguishable from sample to sample variation and test set up variability. Accordingly, as can be seen by line 401 of the graph, there is no statistically significant measurable difference in acoustic transparency between the plasma-treated speaker cover fabric, and the non-plasma-treated speaker cover fabric.

Through hard work and experimentation, the inventors found that using the following parameters worked well for the speaker product in FIG. 2 using a particular plasma chamber:

| | |
|---|---|
| Step | 1 |
| Basepressure (mT) | 20 |
| Max pumpdown (s) | 2400 |
| LR extra (s) | 0 |
| LR test time (s) | 0 |
| Max allowed LR (mT) | 0 |
| Stabilize time (s) | 60 |
| Work pressure (mT) | 50 |
| Gas switching time (s) | 60 |
| RF power (W) | 350 |
| RF pulse | on |
| Flow MFC 1 (sccm) | 0 |
| Flow MFC 2 (sccm) | 0 |
| Flow LMC (sccm) | 120 |
| Process time (s) | 900 |
| Max temp (° C.) | 100 |
| Temperature | |
| heater 1 Cannister (° C.°) | 160 |
| heater 2 Cann-LMS (° C.°) | 160 |
| heater 3 LMS-Chamber (° C.°) | 150 |
| heater 4 pumptubing (° C.°) | 70 |
| heater 5 chamber 1 (° C.°) | 40 |
| heater 6 chamber 2 (° C.°) | 40 |
| heater 7 chamber 3 (° C.°) | 40 |
| heater 8 chamber 4 (° C.°) | 40 |
| heater 9 chamber 5 (° C.°) | 40 |
| heater 10 door (° C.°) | 40 |
| Max time to temp (m) | 60 |

The parameters may vary depending upon the characteristics of the particular speaker cover or product, the size and type of the plasma chamber, etc.

The detailed embodiments described herein are illustrative and should not be taken as limiting the invention. The invention includes all such embodiments as may come within the scope and spirit of the following claims and equivalents thereto.

What is claimed is:

1. A speaker product comprising:
a housing;
at least one driver positioned substantially within the housing; and
a speaker cover coupled with the housing;
the speaker cover comprising a woven or knit material having an initial first acoustic transparency and a plasma coating on the woven or knit material causing a second acoustic transparency, wherein there is no statistically significant difference in acoustic transparency between the first initial acoustic transparency and the second acoustic transparency.

2. The speaker product of claim 1 further comprising:
control circuitry positioned substantially within the housing;
connectivity circuitry positioned substantially within the housing; and
a power source positioned substantially within the housing.

3. The speaker product of claim 1 wherein the woven or knit material includes a woven or knit fabric consisting of one or more of nylon, polyester, or elastomer.

4. A speaker product comprising:
a housing;
at least one driver positioned substantially within the housing; and
a speaker cover coupled with the housing;
the speaker cover comprising a woven or knit material having an initial first acoustic transparency, the woven or knit material treated by a plasma process causing a second acoustic transparency, wherein there is no statistically significant difference in acoustic transparency between the first initial acoustic transparency and the second acoustic transparency, the plasma process comprising:
receiving the material into the plasma chamber;
introducing a fluoro monomer into the plasma chamber;
pulsing plasma for processing;
removing any excess monomer gas from the plasma chamber; and removing the material from the plasma chamber.

5. The speaker product of claim 4 wherein the plasma process further comprises:
achieving a predetermined minimum vacuum;
introducing gas into the plasma chamber for a pre-cleaning treatment phase;
pulsing plasma for pre-cleaning; and
releasing the vacuum.

6. The speaker product of claim 5 wherein the plasma process further comprises determining that the predetermined minimum vacuum has been achieved for a predetermined minimum amount of time.

7. The speaker product of claim 6 wherein the predetermined minimum amount of time is 60 seconds.

8. The speaker product of claim 6 wherein the predetermined amount of time is 60 seconds.

9. The speaker product of claim 5 wherein the predetermined minimum vacuum is between 10 and 100 millitor.

10. The speaker product of claim 5 wherein the predetermined minimum vacuum is 20 millitor.

11. The speaker product of claim 5 wherein the gas is introduced for a predetermined amount of time for pre-cleaning.

12. The speaker product of claim 5 wherein the predetermined minimum vacuum is between 10 and 100 millitor.

13. The speaker product of claim 4 wherein the woven or knit material treated by a plasma process includes a woven or knit fabric consisting of one or more of nylon, polyester, or elastomer.

14. The speaker product of claim 4 wherein the plasma is pulsed for processing for a predetermined amount of time.

15. A speaker product comprising:

a housing;

at least one driver positioned substantially within the housing; and a speaker cover coupled with the housing;

the speaker cover comprising:

a porous material having an initial first acoustic transparency;

a plasma coating on the porous material causing a second acoustic transparency wherein there is no statistically significant measurable difference in acoustic transparency between the initial first acoustic transparency and the second acoustic transparency; and an attachment member for attaching the porous material to a speaker housing.

16. The speaker product of claim 15 wherein the porous material is a woven or knit material.

17. The speaker product of claim 16 wherein the woven or knit material includes a woven or knit fabric consisting of one or more of nylon, polyester, or elastomer.

18. The speaker product of claim 15 wherein the plasma coating on the porous material is caused by a plasma process comprising:

receiving the material into the plasma chamber;

introducing a fluoro monomer into the plasma chamber;

pulsing plasma for processing;

removing any excess monomer gas from the plasma chamber; and removing the material from the plasma chamber.

19. The speaker product of claim 18 wherein the plasma process further comprises:

achieving a predetermined minimum vacuum;

introducing gas into the plasma chamber for a pre-cleaning treatment phase;

pulsing plasma for pre-cleaning; and releasing the vacuum.

20. The speaker product of claim 19 wherein the plasma process further comprises determining that the predetermined minimum vacuum has been achieved for a predetermined minimum amount of time.

* * * * *